United States Patent [19]

Jones, Jr.

[11] Patent Number: 4,747,434

[45] Date of Patent: May 31, 1988

[54] BALSA WOOD STRIPPER

[76] Inventor: James Jones, Jr., 36631 Ledgestone, Mount Clemens, Mich. 48043

[21] Appl. No.: 88,237

[22] Filed: Aug. 24, 1987

[51] Int. Cl.[4] ..... B27C 1/00

[52] U.S. Cl. ..... 144/175; 144/2 R; 144/162 R; 144/184

[58] Field of Search ..... 144/2 R, 162 R, 162 A, 144/175, 184, 190

[56] References Cited

U.S. PATENT DOCUMENTS 81,929 9/1868 Miller ..... 144/175

*Primary Examiner*—W. Donald Bray

*Attorney, Agent, or Firm*—Brooks & Kushman

[57] ABSTRACT

A hand operated balsa wood stripper for cutting sheet balsa wood into strips suitable for constructing wooden models, the balsa wood stripper including a base, a blade for cutting the balsa wood, top and bottom members mounted on the side of the base, said members being slidably adjustable with respect to one another to form a variable depth, U-shaped channel to vary the size of the strips to be cut from the balsa wood. A guiding means is included on the top of the base for guiding the balsa wood into position while the cutting operation is performed.

20 Claims, 1 Drawing Sheet

BALSA WOOD STRIPPER

TECHNICAL FIELD

This invention relates to a balsa wood stripper having an adjustable depth channel.

BACKGROUND ART

In the construction of balsa wood models, there has always been a need for accurate cutting of strips of wood to produce precise models. It is important to not only cut the wood to a precise dimension, but also to do so in an expeditious manner, as well as to do so reproducibly. Wood cut by hand exhibits certain disadvantages such as nonuniform cuts and uncontrolled side angles, while machines which were previously used to perform this task have been difficult to adjust and difficult to use.

The length of a manufactured balsa wood strip should be governed by the sheet size of the balsa, not the length of the straight edge or the size of the machine used to aid the model maker in making cuts. Many prior art methods and machines were constructed such that the machine dictated the length of strip.

Certain prior art machines have included a trough or channel to receive the balsa wood while the operator forced it against a cutting edge. U.S. Pat. Nos. 2,310,604 and 2,423,807 issued to Zindrick disclosed machines which receive the balsa wood through a channel in two manners, (1) laying down or (2) standing up on its edge, respectively. The recited channels each have rough adjustments to regulate the size of the strips. These adjustments are inadequate for producing precise wooden models.

U.S. Pat. No. 4,175,599 issued to Dubois discloses a wood strip cutting device having a plurality of parallel channels of varying depths connected together side by side with a cutter disposed above the channels and means for holding the cutter across the channels at an angle with respect to the channels so that wood which is slid along a selected channel will be cut by the cutter. The wood will be guided both in its approach to the cutter and after it has passed through the cutter. The Dubois invention resorts to providing a plurality of channels to avoid adjustments of the cutter when varying strip sizes are desired. Rather, instead of adjusting the stripper, the channel having the desired depth is selected and used to make the strip.

There are essentially two major problems with the prior art designs:

(1) The adjustment for the strip size is too crude, resulting in nonreproducible cuts, and (2) The means for holding the wood in place as it is being drawn through the channel is insufficient to accurately guide the wood during the cutting operation.

It is an object of the present invention to provide a balsa wood stripper having a greater degree of freedom in adjusting the size of the strip to be manufactured. It is another object of this invention to provide a machine which will support the wood before and after it is cut as well as during the cutting.

SUMMARY OF THE INVENTION

The present invention provides a sheet balsa wood stripper which includes a base having a substantially planar upper surface and an immediately adjacent substantially planar side surface for receiving a piece of balsa wood to be stripped, and at least one fixed blade adjustably mounted on said upper surface, said at least one fixed blade being positioned on the upper surface such that a sufficient portion of the blade extends outwardly over the upper surface edge to slice entirely through the sheet balsa wood to form strips. A fixedly mounted bottom member having an inclined upper surface and scaled markings thereon is permanently attached to the lower region of the substantially planar side surface and receives thereon a slidably adjustable top member having an inclined lower surface and scaled markings which are complementary and in contact with those of the bottom member. The upper surface of said top member does not rise above the upper edge of the base, a fence sandwiches the top and bottom complementary members between itself and the base and thereby forms a variable depth, U-shaped channel for receiving a sheet of balsa wood therethrough and the at least one fixed blade is positioned at the top of the channel so that a sheet of balsa wood pulled through the channel is stripped by the at least one fixed blade to slice a strip the same dimension as the channel. A guiding means is also included on the upper surface of the base for guiding the sheet balsa wood against and positioning the wood during the cutting operation aids in manufacturing.

One advantage of the present invention is that the top member may be raised and lowered easily and precisely by sliding it up and down on the inclined upper surface of the bottom member. This raising and lowering acts to change the channel depth in a very accurate manner which allows the operator to exactly and reproducibly change the dimension of the strip. The scaled markings on both top and bottom members provide precision while changing the channel depth. As the gradations are both in metric and english units, the model maker can use the machine for making both foreign and domestic models.

Another advantage of the present invention is that a guiding means, such as spring, is used to guide the wood into the channel so that pressure is only required in the downward direction by the operator. Previous wood cutters required pressure to be exerted not only in the downward direction, but also in the forward and side-to-side directions. The guiding means of the present invention applies a consistent and uniform amount of pressure, while other hand-held machines use the human hand to apply the necessary consistent and uniform pressure during the cutting operation.

BEST MODE FOR CARRYING OUT THE INVENTION

Figure 2:
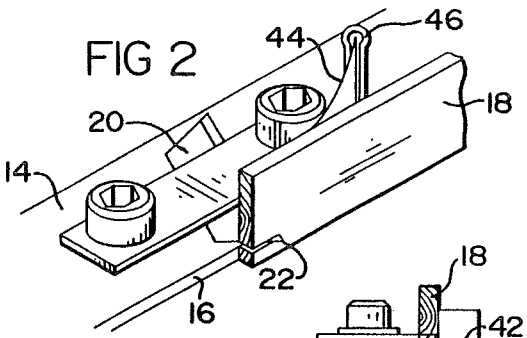
FIG. 2 is a sectional perspective view of stripper showing the cutting action of the blade.
Figure 4:
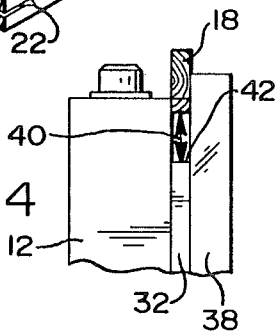
FIG. 4 shows the adjustment means for determining the depth of cut.
Figure 3:
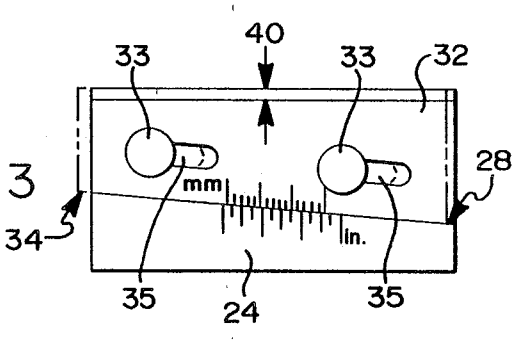
FIG. 3 is an end view of the apparatus of FIG. 1.
Figure 1:
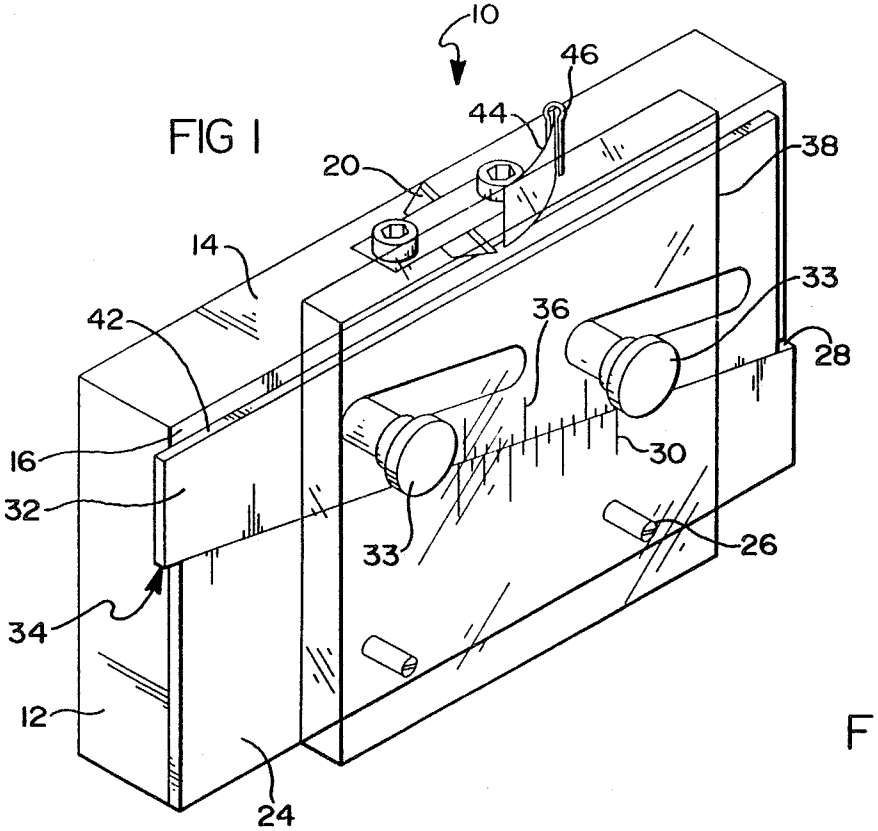
FIG. 1 illustrates one embodiment of the balsa wood stripper.

Referring to FIG. 1, an adjustable balsa stripper illustrating one embodiment of the present invention including a variable depth, U-shaped channel is presented. As shown, the stripper 10 includes a base 12 having a substantially planar upper surface 14 and an immediately adjacent substantially planar side surface 16 for receiving a piece of balsa wood to be stripped. Base 12 is a generally rectangular shaped block, having substantially planar surfaces, and may be made of a material which resists warpage, such as plastic.

At least one fixed blade 20 is adjustably mounted on the upper surface 16. Blade 20 is positioned on the upper surface 16 such that a sufficient portion of the blade 22 extends outwardly over the upper surface edge immediately adjacent the planar side surface to slide entirely through the sheet of balsa wood received therethrough to form strips. The blade 20 should be interchangeable, and may have the configuration of a razor blade or the like. Blade 20 is positioned at an angle with respect to the direction of the movement of the sheet of balsa wood to facilitate stripping of the wood. For instance, blade 20 should be clamped to the top of the base at such an angle that the angle between the edge of the fixed blade and the direction of the wood forms an acute angle. If blade 20 is positioned such that the sufficient portion of the blade 22 is directed at an obtuse angle to the direction of the balsa wood, the slide would be less precise and may cause jamming. In order to achieve multiple strips with one pass of the balsa wood through the stripper, multiple blades may be stacked one of top of the other in a spaced apart relationship for forming multiple strips of wood.

In the instance of multiple blades assembled on the balsa stripper 10, the blades may be in a spaced apart relationship from about 0.001 to about 0.25 inches apart, and preferably about 0.125 inches apart.

A fixedly mounted bottom member 24 is attached to base 12 in a permanent fashion. Bottom member 24 has an inclined upper surface 28 and includes scaled markings 30 thereon. Scaled markings 30 may have gradations of inches and increments therebetween. Bottom member 24 may also be made of a warp-resistant material, such as plastic. Inclined upper surface 28 is shaped to form an upward incline of about 5 to 30 degrees with relation to the lower surface of the bottom member.

A slidably adjustable top member 32 rests on top of bottom member 24. Adjustment means 33 secures top member 32 when it is in position. Top member 32 has an inclined lower surface 34 and scaled markings 36 which are complementary to and in contact with those of the bottom member 24. The upper surface 42 of the top member is not able to rise above the upper surface 14 of the base because adjustment openings 35 are placed in such a fashion as to not permit it. Scaled markings 36 have gradations of centimeters and increments therebetween and are placed in slidable contact with scaled markings 30 of the bottom member 24. Slidably adjustable top member 32 has an inclined lower surface 34 which is shaped to form a downward incline of about 5 to 30 degrees with relation to the upper surface 42 of the top member. The inclines of the lower surface of the top member and the upper surface of the bottom member are designed to be complementary so that the top member 32 can slide on top of bottom member 24 to put marked scalings 30 and 36 in contact so that the top member can be accurately and precisely positioned with respect to the bottom member. Top member 32 should also be formed of a warp-resistant material, such as plastic.

A fence 38 sandwiches the top and bottom complementary members between itself and the base to form a variable depth, U-shaped channel 40 between the base, the upper surface 42 of the top member and the fence for receiving a sheet of balsa wood therethrough. Fixed blade 20 is positioned at the top of the channel 40 so that a sheet of balsa wood 18 pulled through the channel is stripped by the blade to slice a strip the same dimension as the channel.

Again, with combined reference to FIGS. 1, 2, 3 and 4, it may be seen that as top member 32 is slid upward against base 12 and secured with adjustment means 33, channel depth 40 is reduced. Similarly, as top member 32 is slid down on top of bottom member 24, channel 40 has an increased depth, which allows for larger strips of wood to be manufactured.

Channel 40 formed by the base, the top member and the fence may have a depth dimension from about 0.001 to about 0.5 inches, and preferably about 0.0625 inches for commercially available sheets of balsa wood. Channel 40 has a width dimension of from about 0.001 inches to about 0.25 inches, preferably 0.125 inches. It is preferable for all parts, the base, the top member and the fence to be formed of warp-resistant material, such as plastic so that gradations 30 and 36 will always be accurate.

Guiding means 44 is intended to guide the sheet balsa wood against the fence and position the wood so that the at least one blade strips the wood in a uniform fashion. As illustrated, guiding means 44 includes a spring for urging the wood into position. Consequently, the operator need only use his hand to apply pressure to the balsa wood in a downward and forward direction, rather than simultaneous downward, sideward, and forward directions as required by the prior art inventions.

In the present embodiment, guiding means 44 is illustrated as a spring held in place by a cotter pin 46, but it must be appreciated that any guiding means and securement for the guiding means may be utilized.

While the best mode of the present invention is disclosed above, the invention is not limited to that embodiment. The invention is not to be limited, rather the invention should be interpreted with respect to the following claims.

What is claimed is:

1. A hand-operated adjustable balsa wood stripper for stripping sheet balsa wood into strips suitable for constructing wooden models, comprising:

a base having a substantially planar upper surface and an immediately adjacent substantially planar side surface for receiving a piece of balsa wood to be stripped;

at least one fixed blade adjustably mounted on said upper surface, said at least one fixed blade being positioned on the upper surface such that a sufficient portion of the blade extends outwardly over the upper surface edge immediately adjacent the planar side surface to slice entirely through the sheet balsa wood received therethrough to slice strips;

a fixedly mounted bottom member having an inclined upper surface and scaled markings thereon is permanently attached to the lower region of the substantially planar side surface and receives thereon a slidably adjustable top member having an inclined lower surface and scaled markings which are complementary to and in contact with those of the bottom member, the upper surface of said top member not rising above the upper surface of the base;

a fence which sandwiches the top and bottom complementary members between itself and the base forms a variable depth, U-shaped channel between the base, the upper surface of the top member and the fence for receiving a sheet of balsa wood therethrough and said at least one fixed blade being positioned at the top of the channel so that a sheet of balsa wood pulled through the channel is stripped by the at least one fixed blade to slice a strip the same dimension as the channel; and a guiding means for guiding the sheet balsa wood against the fence and positioning the wood so that the at least one blade strips the wood.

2. A balsa stripper as in claim 1, wherein said base is a rectangular shaped block having substantially planar surfaces.

3. A balsa stripper as in claim 1, wherein said base is made of a material which resists warpage.

4. A balsa stripper as in claim 1, wherein said base is made of plastic.

5. A balsa stripper as in claim 1, wherein said at least one fixed blade is positioned at an angle with respect to the direction of movement of the sheet of balsa wood to facilitate stripping of the wood.

6. A balsa stripper as in claim 1, further comprising multiple blades one on top of the other in a spaced apart relation for forming multiple strips of wood.

7. A balsa stripper as in claim 6, wherein said blades in a spaced apart relation are from about 0.001 to about 0.25 inches apart.

8. A balsa stripper as in claim 7, wherein said blades in a spaced apart relation are about 0.125 inches apart.

9. A balsa stripper as in claim 1, wherein said fixedly bottom member includes scale markings having gradations of inches and increments therebetween.

10. A balsa stripper as in claim 1, wherein said bottom member is made of a warp resistant material.

11. A balsa stripper as in claim 1, wherein said bottom member having an inclined upper surface is shaped to form an upward incline of about five to thirty degrees with relation to the lower surface of the bottom member.

12. A balsa stripper as in claim 1, wherein said slidably adjustable top member includes scaled markings having gradations of centimeters and increments therebetween.

13. A balsa stripper as in claim 1, wherein said inclined lower surface of the slidably adjustable top member is shaped to form a downward incline of about five to thirty degrees with relation to the upper surface of the top member, and said incline to be complementary to the incline of the bottom member to which it contacts.

14. A balsa stripper as in claim 1, wherein said top member is made of a warp-resistant material.

15. A balsa stripper as in claim 1, wherein said channel formed by the base, the top member and the fence has a depth dimension from about 0.001 inches to about 0.5 inches.

16. A balsa stripper as in claim 15, wherein said channel has a depth dimension of about 0.0625 inches.

17. A balsa stripper as in claim 1, wherein said channel has a width dimension of from about 0.001 inches to about 0.25 inches.

18. A balsa stripper as in claim 17, wherein said channel width dimension is about 0.125 inches.

19. A balsa stripper as in claim 1, wherein said fence is made of a warp-resistant material.

20. A hand-operated adjustable balsa wood stripper for stripping sheet balsa wood into strips suitable for constructing wooden models, comprising:

a substantially rectangular base block made of a warp-resistant material having substantially planar surfaces;

a cutting blade clamped to the top surface a portion of the cutting blade extending over the top edge;

top and bottom substantially planar members adjacent to the side surface of the base block;

said top and bottom members having abutting complementary respective lower and upper inclined surfaces, said top member being slidably affixed in relation to the side surface of the base block and the top member, and said bottom member being permanently affixed to the side surface of the base block to provide a stationary inclined surface upon which the top member is able to slide;

a permanently secured fence for holding the top and bottom members against the side surface having a means for permanently securing both the fence and the bottom member to the base block while allowing the top member to adjustably slide between the fence and the side surface of the base block on the upper inclined surface of the bottom member; said fence, top member and base block forming a variable depth, U-shaped channel for receiving a sheet of balsa wood therethrough;

said cutting blade being positioned at the top of the channel so that a sheet of balsa wood pulled therethrough is cut to form a strip the same dimension as the channel; and a spring clip mounted on the top of the base block for stabilizing the sheet of balsa wood and pressing the same against the fence during the cutting operation.

* * * * *